US005735083A

United States Patent [19]

Brown et al.

[11] Patent Number: 5,735,083

[45] **Date of Patent: *Apr. 7, 1998**

[54] BRAIDED AIRBEAM STRUCTURE

[76] Inventors: Glen J. Brown, 458 Thayer Rd., Santa Cruz, Calif. 95060; Garrett C. Sharpless, 9 Wood Rd., Sherborn, Mass. 01770

[ * ] Notice: The term of this patent shall not extend beyond the expiration date of Pat. No. 5,421,128.

[21] Appl. No.: 426,398

[22] Filed: Apr. 21, 1995

[51] Int. Cl.[6] ..... E04C 3/02; B60C 29/00; E04H 15/20

[52] U.S. Cl. ..... 52/2.13; 52/DIG. 8

[58] Field of Search ..... 52/2.11, 2.13, 52/2.18, 2.21, DIG. 8

[56] References Cited

U.S. PATENT DOCUMENTS

| | | | |
|---|---|---|---|
| 2,689,812 | 9/1954 | Mollica et al. | 52/2.11 X |
| 2,765,014 | 10/1956 | Müller | 52/2.21 |
| 2,771,899 | 11/1956 | Swallert | 52/2.21 X |
| 4,585,044 | 4/1986 | Carrera et al. | 152/165 |
| 5,311,706 | 5/1994 | Sallee | 52/2.18 |
| 5,421,128 | 6/1995 | Sharpless et al. | 52/2.13 |

*Primary Examiner*—Robert Canfield
*Attorney, Agent, or Firm*—Frank C. Price

[57] ABSTRACT

An air beam made up of a cylindrical braid and lined with a gas-retaining bladder is improved in its resistance to wrinkling or buckling by incorporating linear bundles of fibers extending parallel to the axis of the cylindrical braid within the cylindrical weave and spaced around the circumference of the cylindrical weave. Another implementation is used when the required strength of the axial bundles implies that they will not fit within the braid, in which case, the bundles are made up into external straps retention means is a coating applied to the braided fibers.

7 Claims, 3 Drawing Sheets

BRAIDED AIRBEAM STRUCTURE

BRIEF SUMMARY OF THE INVENTION

This is the invention of an improved construction for structural pressurized tubes, commonly referred to as airbeams, and, particularly, to airbeams constructed of fibers braided to define the surface of a pressurized tube. A braided fiber structure consists of bias fibers that spiral along the length of the tube, each half of the fibers at equal and opposite bias angles, interwoven by the braiding process. A braided fiber structure also optionally includes "axial" fibers traveling the full length of the tube at zero bias angle (parallel to the axis of the tube) interleaved within the crossings of the bias fibers. These axial fibers, as braided fibers, would be cords. When axial fibers are included at every bias crossing location, the braid is commonly referred to as "tri-axial". This invention relates to improved braid constructions in which axial fibers are preferentially placed in only certain bias crossing locations in order to tailor an airbeam for particular structural characteristics. This invention also extends such braided constructions to include the use of axial strength members that are bonded externally to the bias braid without being captured within the braid.

Areas of a braid having a concentration of axial fibers are referred to as "stripes" because of the visual appearance of such a construction. In order to illustrate the advantages of such constructions, consider the case of an airbeam constructed with two stripes. Such an airbeam, sometimes referred to as a "spar braid", has the following advantages:

1. The pre-wrinkle stiffness against bending in the plane of the stripes is greater than a triaxial braid beam with the same total amount of axial fiber, the moment of inertia being up to two times greater for that bending axis.

2. The wrinkle onset moment for bending in the plane of the stripes is up to two times greater than with a tri-axial braid beam.

3. As long as the stripes are relatively narrow, the spar braid beam can be buckled without damage at a pressure that would readily fail the axial fibers in a triaxial braid beam with the same total amount of axial fiber.

A braid with three or more axial fiber bundles will resist bending about all axes. It has the same advantages listed above, compared to a tri-axial braid beam, of higher wrinkle onset moment and damage-free buckling with light-weight construction.

The pre-wrinkle stiffness in bending, the stiffness of the beam while all fibers have positive tension, is higher because the moment of inertia in the plane of bending is higher than that of a full tri-axial braid. This is visualized most easily for the spar braid construction for which there are no axial fibers on the neutral axis not contributing to the moment of inertia, while the full tri-axial braid includes fibers on and near the neutral axis under axial preload caused by the pressure itself. The wrinkle-onset moment, the lowest bending moment that causes at least one fiber to have zero tension, is increased with fiber bundle axials, compared to triaxial braids because the axial pre-load is concentrated and is at a higher value in the fiber bundles, so that a higher bending moment is required to reduce the tension to zero.

Buckling occurs after the wrinkle-onset moment has been exceeded. Increased bending causes a wrinkle to form at the inside of the bend and to progressively travel around the circumference of the tube, until the axial load is concentrated into a very small unwrinkled arc. If the axial fibers are distributed uniformly around the circumference, then the concentrated load caused by the buckling will typically cause those fibers to fail before the tube is fully buckled. By concentrating the fibers into bundles, each of high enough strength to sustain the full axial reaction to inflation pressure, no damage can be done by buckling.

DESCRIPTION OF THE PREFERRED EMBODIMENT

Figure 1:
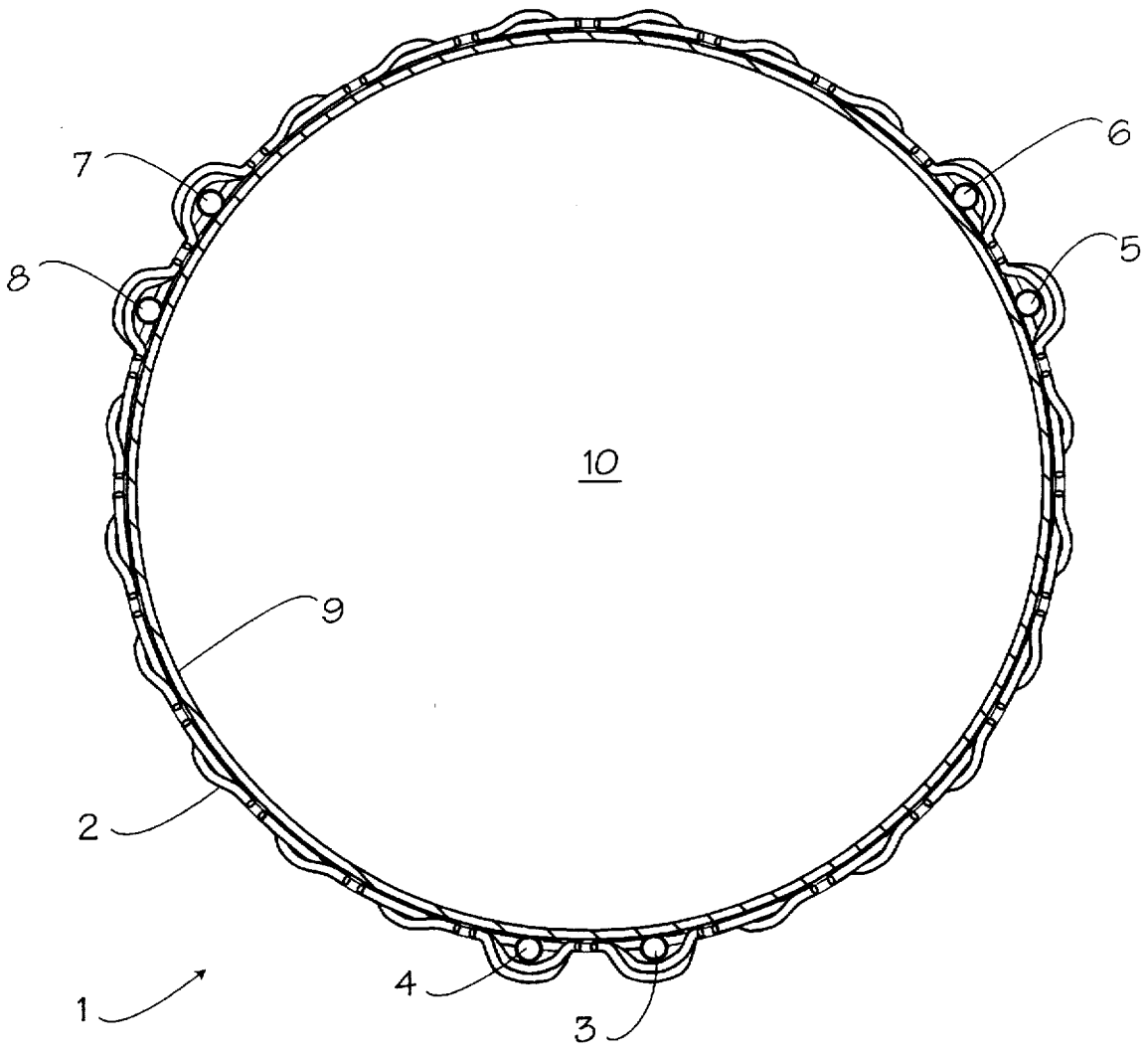
FIG. 1 shows the end cross sectional view of an air beam with three axial bundles of fibers.

In FIG. 1 is seen the cross section of the air beam 1 with its bias braid fibers forming a cylindrical braid 2 lined by a bladder 9. The bladder 9 is made of elastomeric material to seal in the air which creates the air beam stiffness. The air pressurized interior of the beam is 10. In this case three fiber bundles consisting of pairs of bundles of axial fibers 3 & 4, 5 & 6, and 7 & 8 are spaced at 120 degrees around the circumference of the cylindrical braid. The axial fibers are surrounded by and held in place by the fibers of the braid 2.

Figure 2:
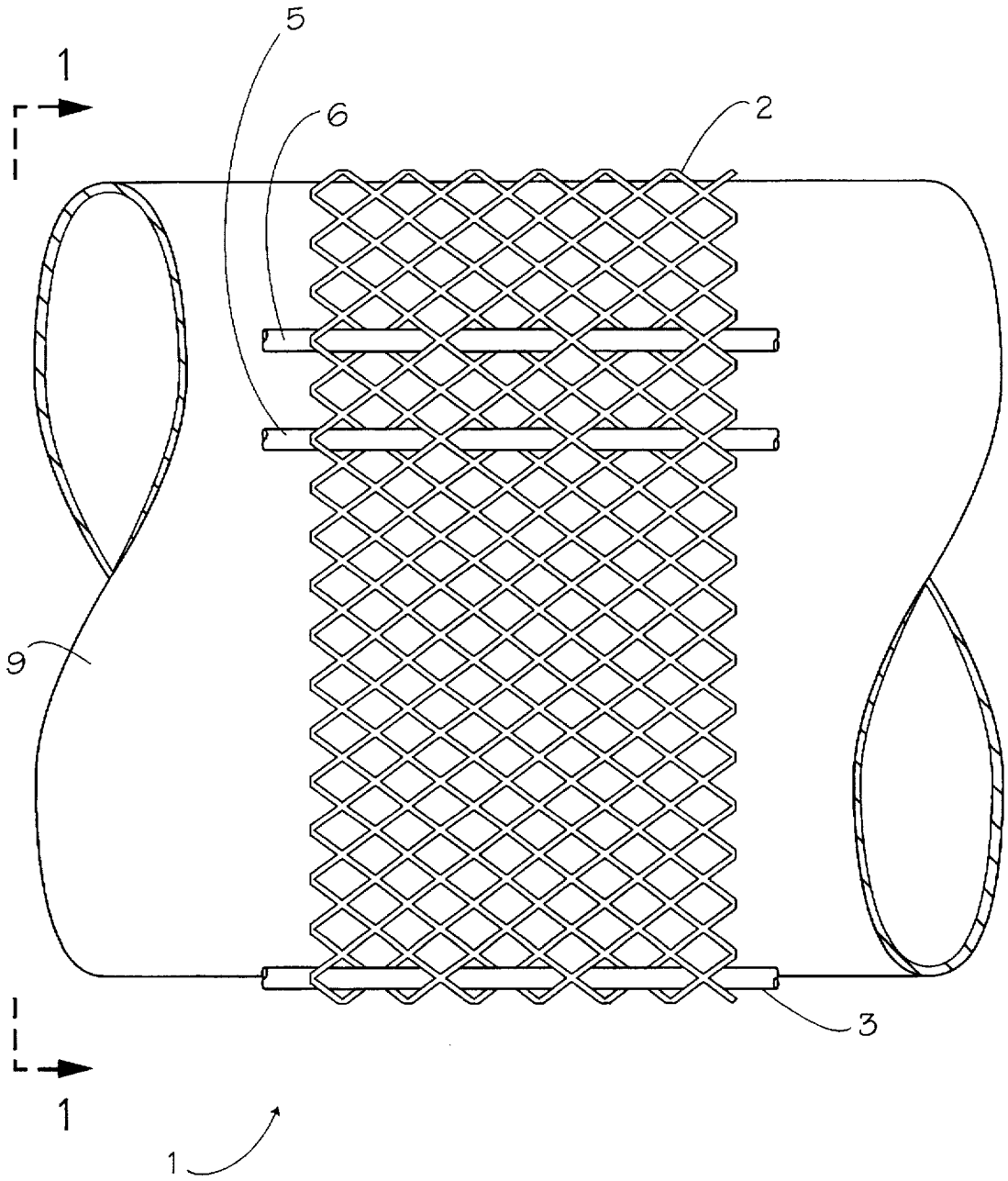
FIG. 2 shows the side view of a portion of the tube of FIG. 1 with the axial bundles of fibers included within the bias braid fibers.

In FIG. 2 can be seen the air beam 1 with its cylindrical fibers 2 and its bladder 9. The axial bundles of fibers 3, 5 and 6 can be seen. Both FIG. 1 and FIG. 2 show the axial bundles 3 & 4, 5 & 6, and 7 & 8 contained within the cylindrical braid although all are not in view in FIG. 2.

Figure 3:
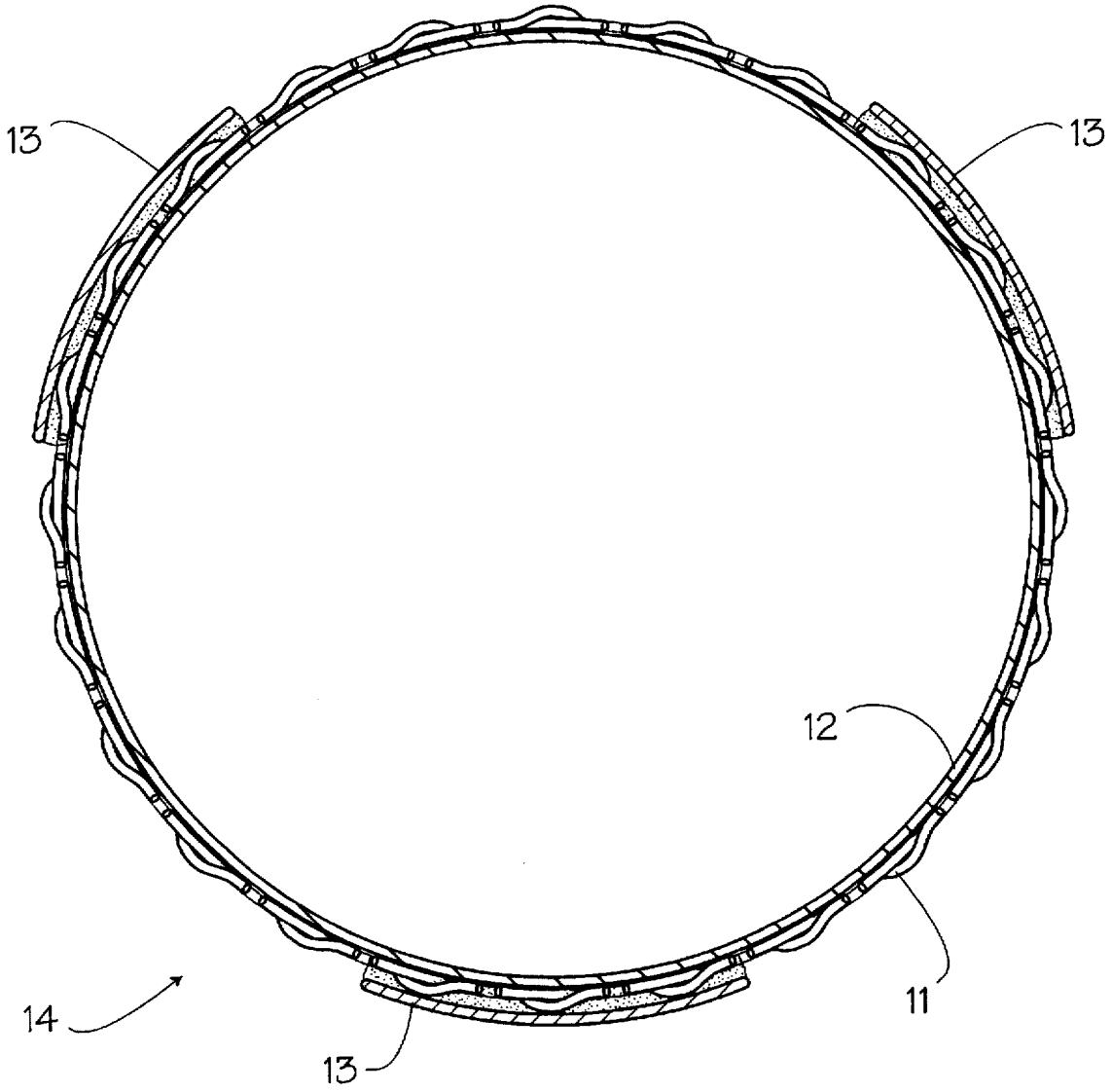
FIG. 3 shows the end cross section of a portion of a tube similar to the tube in FIG. 1, but with flat straps or webbing being used as axials, with the webbing lying along the outside surface of the braided tube.

In. FIG. 3 is seen an air beam 14 with bias braid fibers forming a cylindrical braid 11 and bladder 12. Webbing 13 is disposed axially on the surface of the braid 11. Attachment means such as cement or elastomeric bond hold the webbing 13 to the surface of the braid. The bladder 12, as seen in FIG. 3, can also represent a coating of elastomer on the inside of the fiber wall rather than a bladder installed as a separate part.

We claim:

1. An inflated tube, said tube being made up of a tube wall, said tube having an axis, said axis defined by the longitudinal center of said tube, comprising:

braided fibers defining the surface of said tube, said fibers following continuous left and right spiral paths over the length of said tube wall; axial fibers located along said tube wall, said axial fibers following paths parallel to said axis, said axial fibers being distributed at intervals around the circumference of said tube wall; pressurizing gas inflating said tube; and retention means for said gas.

2. The tube of claim 1 in which said axial fibers are contained within spaces formed between said braided fibers.

3. The tube of claim 1 in which said axial fibers are concentrated in two or more areas spaced at intervals arranged around the circumference of said tube, the areas containing said axial fibers being separated by areas containing no axial fibers.

4. The tube of claim 1 in which said axial fibers are made from woven webbing.

5. The tube of claim 1 in which said axial fibers are contained within braided cords.

6. The tube of claim 1 in which said gas retention means is a liner of elastomeric film located inside a cylinder defined by said braided fibers.

7. The tube of claim 1 in which said gas retention means is a coating of elastomeric material applied to said braided fibers.

* * * * *